US006070544A

United States Patent [19]

Finley

[11] Patent Number: 6,070,544

[45] **Date of Patent: *Jun. 6, 2000**

[54] BOAT WITH OUTRIGGERS

[75] Inventor: John Finley, Joplin, Mo.

[73] Assignee: Tri-Span, L.L.C., Joplin, Mo.

[ * ] Notice: This patent is subject to a terminal disclaimer.

[21] Appl. No.: 08/914,334

[22] Filed: Jul. 14, 1997

Related U.S. Application Data

[63] Continuation-in-part of application No. 08/611,389, Mar. 5, 1996, Pat. No. 5,647,294.

[51] Int. Cl.[7] ..... B63B 1/00

[52] U.S. Cl. ..... 114/61.1; 114/61.15; 114/61.17; 114/123

[58] Field of Search ..... 114/61, 123, 61.1, 114/61.14, 61.16, 61.17, 61.18, 61.19, 61.15

[56] References Cited

U.S. PATENT DOCUMENTS

| | | | |
|---|---|---|---|
| 725,264 | 4/1903 | Von Malein | 114/123 |
| 990,759 | 4/1911 | Maggio | 114/123 |
| 1,710,625 | 4/1929 | Kapigian | 114/123 |
| 2,678,018 | 5/1954 | Crisp | 114/123 |
| 3,276,413 | 10/1966 | Dolph et al. | 114/123 |
| 3,960,102 | 6/1976 | Davy | 114/123 |
| 4,159,006 | 6/1979 | Thurston | 114/123 |
| 4,172,426 | 10/1979 | Susman | 114/61 |
| 4,213,412 | 7/1980 | Jamieson | 114/61 |
| 4,228,750 | 10/1980 | Smith et al. | 114/39 |
| 4,286,533 | 9/1981 | Sanner | 114/39 |
| 4,294,184 | 10/1981 | Heinrich | 114/61 |
| 4,465,008 | 8/1984 | Liggett | 114/39 |
| 4,644,890 | 2/1987 | Lott | 114/61 |
| 4,878,447 | 11/1989 | Thurston | 114/61 |
| 4,898,113 | 2/1990 | Tapley et al. | 114/283 |
| 4,943,250 | 7/1990 | Du Pont | 440/101 |
| 5,277,142 | 1/1994 | Connor | 114/61 |

OTHER PUBLICATIONS

Deborah Druan, "The Power Trimarans: Ilan Vogayer," Multihulls (magazine), Oct./Nov. 1989.

*Primary Examiner*—Stephen Avila
*Attorney, Agent, or Firm*—Jonathan A. Bay

[57] ABSTRACT

A boat has a main hull and a pair of outriggers which extend to distal, capsizing-resistance formations. The capsizing-resistance formation are relatively diminutive:—they displace a substantially small fractional amount of water relative to what the main hull displaces. Also, the capsizing-resistance formations are shaped and arranged such that in contact with the water under forward velocity it provides a generally upward capsizing-resistance force through a given center of action, which force is transmitted by the outrigger to the main hull as an applied capsizing-resistance moment. Given the foregoing, the outriggers position of the capsizing-resistance formations generally outboard and rearward such that said centers of the upward capsizing-resistance force lie spaced substantially outboard or behind a plane containing the stern of the main hull in order to stabilize the fore-to-aft pitching as well as side-to-side rolling of the main boat hull in accordance with boat speed and wave conditions. The capsizing-resistance formations can be either floats shaped and arranged to skim the water surface and provide an upward capsizing-resistance force which comprises a combination of buoyancy and planing forces, or else planes shaped and arranged to plane on the water surface and provide an upward capsizing-resistance force which comprises substantially planing forces, or alternatively asymmetric foils shaped and arranged to plane the water surface or fly if submerged and provide an upward capsizing-resistance force which is alternatively substantially a planing force or hydrodynamic lift.

18 Claims, 9 Drawing Sheets

BOAT WITH OUTRIGGERS

CROSS-REFERENCE TO RELATED APPLICATION

This is a continuation-in-part of application Ser. No. 08/611,389, filed Mar. 5, 1996 now U.S. Pat. No. 5,647,294, issued Jul. 15, 1997.

BACKGROUND OF THE INVENTION

1. Field of the Invention

The invention relates to boat having outriggers. The outriggers extend to distal portions formed as capsizing-resistance formations, which are positioned in divergent positions such as simultaneously partly outboard of the central hull's side beam and partly rearward of the central hull's stern, in order to give the boat lateral side-to-side and/or fore-to-aft stability. The capsizing-resistance formations are diminutive relative to the main hull, and are shaped to plane and/or fly through the water in order to give back a moderate capsizing-resistance force. Such a moderate capsizing-resistance force is amplified into a substantial capsizing-resistance moment for the main boat hull if the outriggers are given sufficient extension.

2. Prior Art

Outriggers appear on a variety of water craft, from seagoing canoes to plural-hull vessels such as catamarans, trimarans and the like. Outriggers appear on canoes and plural-hull vessels in various configurations. The basic outrigger configuration on a seagoing canoe comprises a laterally-extending spar cantilevered at one end to the canoe hull, and terminating in an opposite end that supports a float substantially spaced away from the outboard beam of the canoe hull. The outrigger thereby gives the canoe lateral stability not otherwise present.

The configuration of outriggers for trimarans is similar except that an outrigger structure is mounted on each side of a central hull so that the central hull is flanked by a pair of opposite outrigger floats. Examples, among others, are shown by U.S. Pat. No. 3,960,102—Davy, and U.S. Pat. No. 4,465,008—Liggett. In some catamaran configurations, a pair of laterally spaced floats are interconnected by spars upon which a central deck is elevated off the water. See, for example, U.S. Pat. No. 4,286,533—Sanner, and U.S. Pat. No. 5,277,142—Connor.

In addition to the above-listed U.S. patent references, further outrigger configurations are shown by U.S. Pat. No. 4,159,006—Thurston, U.S. Pat. No. 4,172,426—Susman, U.S. Pat. No. 4,213,412—Jamieson, U.S. Pat. No. 4,294,184—Heinrich, and U.S. Pat. No. 4,898,113—Tapley et al. (i.e., on a sail-board).

The above-listed U.S. patent references are alike in disclosing floats which are sized on an equivalent scale as the central or main hull of the craft (i.e. equal to at least one-half of, and usually larger than, the geometry of the central or main hull of the craft). Some of the above-listed U.S. patent references disclose adjustable outriggers, and, of these, most have the floats movably mounted for displacement between an extended-out "use" position and a retracted in "storage" position, as for trailering or docking and the like.

There are shortcoming associated with the prior art outrigger configurations. The bows of the outrigger floats typically plow out spray which can fall back on to the deck of the central or main hull, and thereby soak passengers if the spray is not appropriately shielded or blocked by closed decks and the like. Additionally, the prior art outrigger floats, while typically giving the central or main hull effectively greater lateral (or side-to-side) stability, fail to be configured and positioned in arrangements which would give the central or main hull greater fore-to-aft stability. What is needed is an improvement in an outrigger configuration which addresses these shortcomings.

SUMMARY OF THE INVENTION

It is an object of the invention to provide a high speed boat such as a motor boat or the like with improved stability both in the lateral side-to-side direction as well as the fore-to-aft (or front-to-back) direction by means of outriggers.

It is an alternate object of the invention that the above outriggers are arranged relatively long, and extend to distal portions formed as relatively diminutive capsizing-resistance formations, which in combination the outriggers and capsizing-resistance formations provide a substantial capsizing-resistance moment by means of the outriggers being long in combination with the capsizing-resistance formations providing a moderate upward capsizing-resistance force.

It is an additional object of the invention that the above capsizing-resistance formations be about any shape or design in order to get the desired capsizing-resistance force, including without limitation floats, shaped and arranged to skim the water surface and provide an upward capsizing-resistance force which comprises a combination of buoyancy and planing forces, or else planes, shaped and arranged to plane on the water surface and provide an upward capsizing-resistance force composed substantially of planing forces, or alternatively asymmetric foils, shaped and arranged to plane the water surface or fly if submerged and provide an upward capsizing-resistance force which is alternatively substantially a planing force or else hydrodynamic lift.

It is another object of the invention outriggers be adjustable such that the capsizing-resistance formations can be set in divergent positions both substantially outboard of the side-beams and substantially rearward of the stern of the main hull.

It is a further object of the invention that the capsizing-resistance formations be shaped and arranged so that the spray which trails them is thrown in the direction away from the main hull in order not to soak the passengers.

These and other aspects and objects are provided according to the invention in a boat that has a main hull and a pair of outriggers which extend to distal, capsizing-resistance formations. The capsizing-resistance formation are relatively diminutive:—they displace a substantially small fractional amount of water relative to what the main hull displaces. Also, the capsizing-resistance formations are shaped and arranged such that in contact with the water under forward velocity it provides a generally upward capsizing-resistance force through a given center of action, which force is transmitted by the outrigger to the main hull as an applied capsizing-resistance moment.

Given the foregoing, the outriggers position of the capsizing-resistance formations generally outboard and rearward such that said centers of the upward capsizing-resistance force lie spaced substantially outboard or behind a plane containing the stern of the main hull in order to stabilize the fore-to-aft pitching as well as side-to-side rolling of the main boat hull in accordance with boat speed and wave conditions.

The capsizing-resistance formations can be either floats shaped and arranged to skim the water surface and provide an upward capsizing-resistance force which comprises a combination of buoyancy and planing forces, or else planes shaped and arranged to plane on the water surface and provide an upward capsizing-resistance force which comprises substantially planing forces, or alternatively asymmetric foils shaped and arranged to plane the water surface or fly if submerged and provide an upward capsizing-resistance force which is alternatively substantially a planing force or hydrodynamic lift. In accordance with any of the above versions, a relatively diminutive capsizing-resistance formation (i.e., "diminutive" relative to the size of the main hull) can give at velocity a substantial capsizing-resistance moment.

The outriggers can be configured in various arrangements including either fixed or adjustable arrangements. The adjustable arrangement preferably comprises an adjustable mechanism that allows adjustment of the position of the capsizing-resistance formations among various positions of generally outboard and rearward such that said centers of upward capsizing-resistance force lie spaced substantially outboard of the side beams of, and/or behind a plane containing the stern of the main hull.

One version of the adjustable mechanisms comprises a turntable base for the outrigger that allow swivelling between extreme clockwise and counterclockwise positions. The turntable base preferably includes clamping arrangements to lock the turntable base in various given positions. The clamping arrangement can include at least one twistable bolt or nut which has cleat-shaped prongs projecting from it. In other versions of the adjustable mechanism, it comprises telescoping sections that are extendible and retractable between extended and foreshortened extremes.

The outriggers can be mounted to the main hull in various locations, and disclosed herein are mountings at the opposite rear corners thereof as well at amidships. The main hull can be given about any water craft shape including but not limited to motor boat and sail craft hull-shapes.

It is believed that the reason outriggers are unpopular on high speed craft such as motorboats is that the prior art configuration of outriggers and pontoons throw too much spray back into the passenger compartment. This soaks the passengers and is very unpleasant regardless if the water is not frigid or otherwise. It is an object of the invention to provide lateral and fore-to-aft stability for high speed craft at the same time as not detracting from the comfort of the ride from a passenger's vantage point. In other words, that is, the passengers ought not to have to sacrifice dryness comfort for stability. Thus it is an object of the invention that the capsizing-resistance formations in accordance with the invention be shaped, arranged and located so as avoid throwing spray into the passenger compartment.

The foregoing object is partly achieved by the invention by such improvements as relatively elongated outriggers carrying relatively diminutive capsizing-resistance formations at relatively great distances from the main hull, both outboard and rearward. However, the foregoing object of the invention is also achievable in part if care is taken with the shape and arrangement of the capsizing-resistance formations. To that end, it is preferable if the proximal and distal side surfaces of the capsizing-resistance formation are shaped such that, the distal side surface is inclined outboard in the upward direction, and, the proximal side surface is oriented either one of generally vertical or inclined outboard in the upward direction, so that the spray that the capsizing-resistance formation displaces under forward velocity is thrown outboard and away from the main boat hull.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
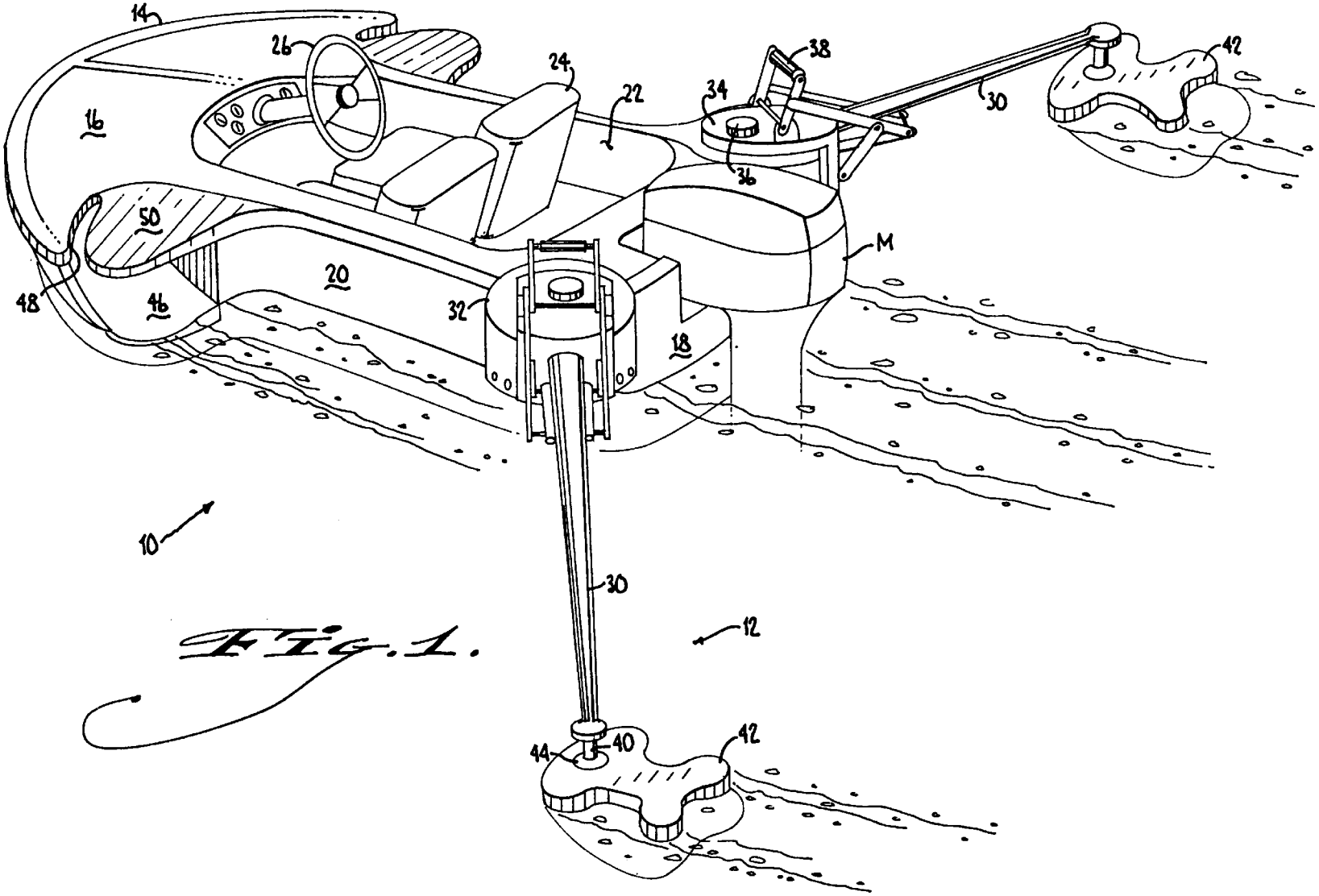
FIG. 1 is a perspective view of a boat with adjustable outriggers in accordance with the invention.
Figure 2:
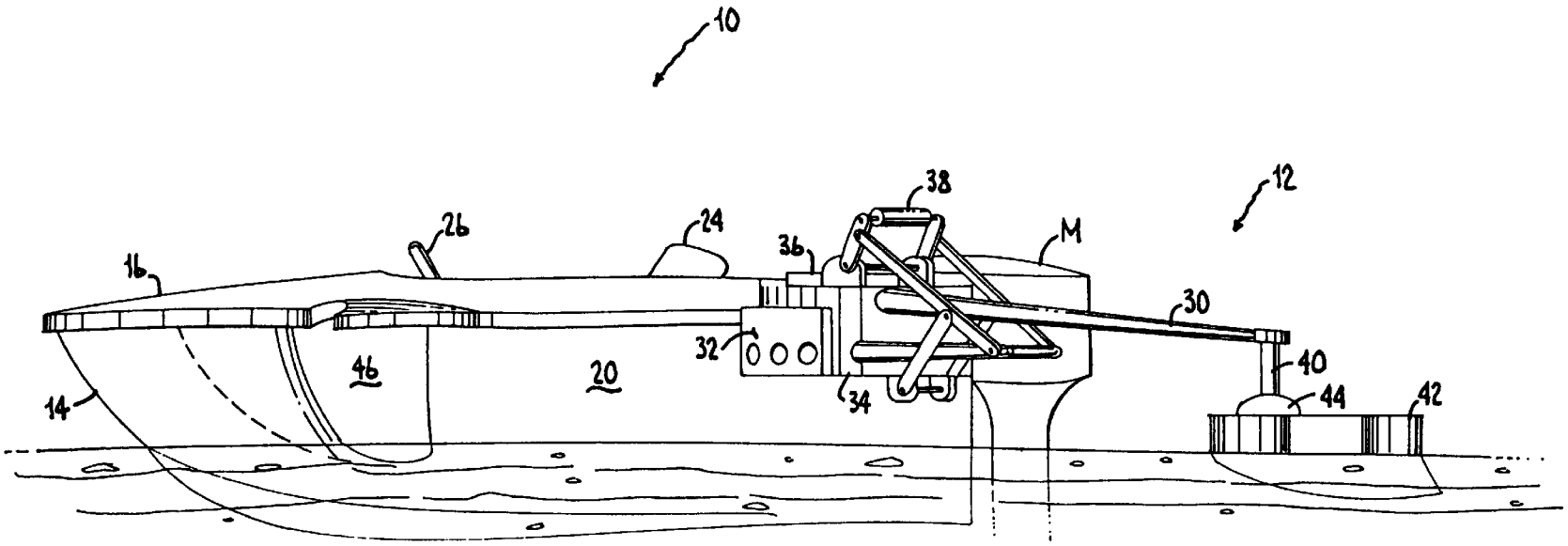
FIG. 2 is a side elevational view thereof.
Figure 3:
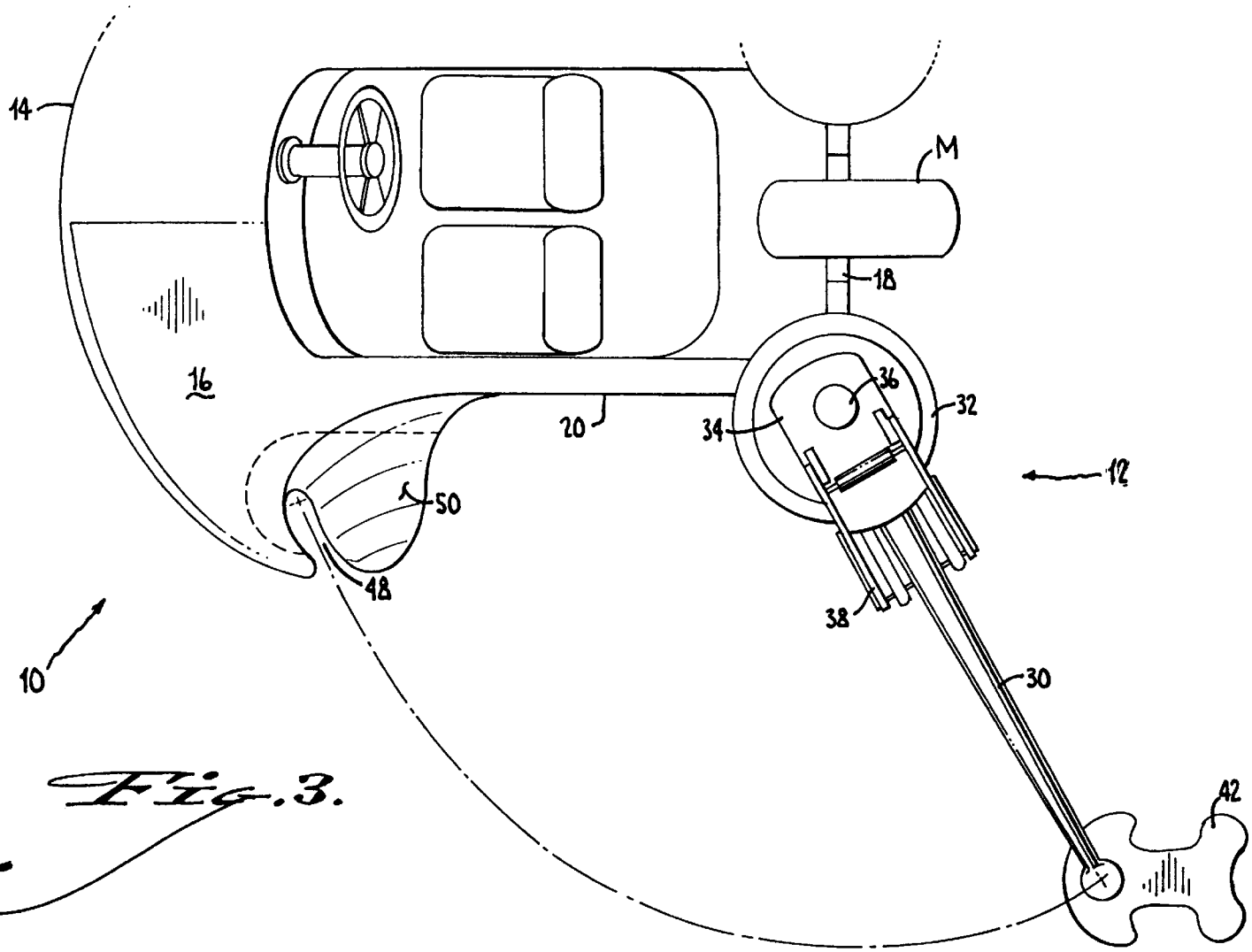
FIG. 3 is a top plan view thereof, with portions broken away.

In FIGS. 1 through 3, a boat 10 with adjustable outriggers 12 in accordance with the invention is shown powered by an outboard motor M. In the drawings, the boat 10 is a motor-propelled boat. However, the adjustable outriggers 12 in accordance with the invention can be deployed on other water craft as well and, accordingly, the depiction and description here of a motor-propelled boat is used merely for convenience in this specification and does not limit the invention.

The boat 10 comprises a central or main hull 14 having an enlarged bow 16, an enlarged stern 18 across the middle of which the motor M is mounted, and a necked-in intermediate portion 20 extending between the bow 16 and stern 18. The main hull 14 also has a passenger compartment 22 carrying a pair of passenger seats 24, and a steering wheel 26 which, along with other accessories (not shown), are customary on motor-powered boats of this type.

The preferred configuration of this boat hull 14 (i.e., excluding the outriggers 12 and motor M) is given a bow-to stern length of about 12 feet (3.6 m) and a beam-to-beam width of about 5 feet (1.5 m). The boat 10 preferably retains this size when the outriggers 12 are fully swung forward in the extreme forward position (i.e., the "storage position, not shown). This would be advantageous for various purposes, such as, for example, for more convenient trailering over the roadways or for passage through narrow inlets, and the like. Additionally, the boat 10 (including the outriggers 12 but excluding the motor M) preferably weighs generally between 200 and 250 pounds (90 and 115 Kg) for convenience of hoisting up off the water or towing in the water, as a dinghy, as to service a larger craft. The preferred utility for the boat 10 would include duties as a seagoing fishing boat with capabilities of squeezing through narrow inlets (with the outriggers stored) as well as negotiating moderately swelling seas at open speeds (with the outriggers deployed in "use" positions as shown).

One inventive aspect here concerns the outriggers 12. There are two opposite outrigger spars 30 mounted on the left and right extreme rear corners 32 of the boat hull 14. These corners 32 are given at least a semi-circular turret shape and carry swivel-mounted brackets 34 in which the outrigger spars 32 are securely cantilevered. The swivel-brackets 34 are attached to the turret corners 32 via swivel pins 36. The swivel-brackets 34 include locking mechanisms 38 which will be more fully described below.

The spars 30 are given a cross-sectional shape of a tear-drop, as is usually seen in sail-boat masts, to reduce drag through the air and/or water while moving forward. Each spar 30 extends to a terminal end that carries a down-link 40 that connects to a float 42. Each down-link 40 terminates, at its lower end, in a ball structure to insert in a complementary socket structure in the float 42 to form a ball-and-socket joint 44 between the down-link 40 and the float 42.

As shown better by FIG. 3, each float 42 has plan-view profile that mimics the plan-view profile of the boat hull 14 except for being a smaller scale version. The socket structure 44 that is formed in the float 42 is located on the axis of symmetry of the float relative to side-to-side symmetry thereof, but otherwise is located relatively forward of the center of geometry of the float's plan-view profile. FIG. 2 shows the appearance of the floats 42 (left side only shown in FIG. 2) in respect of their side-view profile. From the side-view vantage point, the floats 42 are relatively deep or thick. This gives the floats 42 increased buoyancy or flotation so that they won't easily sink or plow deeply into oncoming waves when moved forwardly at the open speeds of the boat 10.

With general reference again to FIGS. 1 through 3, the outrigger spars 30 are about 8 feet (2.4 m) long. If the outriggers 12 are positioned to extend straight out from the sides of the boat hull 14 (such extension not shown), the floats 42 would be spaced about 21 feet (6.4 m) apart. As shown in FIGS. 1 through 3, the outriggers 12 are positioned to form a tripod arrangement among the floats 42 and main hull 14. This is a preferred arrangement for the purpose of at least keeping the spray that the floats 42 plow up from coming back onto the passengers in the passenger compartment 22. The tripod arrangement also gives other advantages too. The tripod arrangement acts to dampen not only the lateral or side-to-side rolling of the main hull 14, but also fore-to-aft pitching. Put differently, the tripod arrangement increases not only the lateral stability of the boat hull 14, but also the front-to-back stability as well.

The outrigger spars 30 can be made of any suitable material, such as aluminum or a polymer or resinous material, so that the spars 30 can deflect upwardly or downwardly when the main hull 14 rolls. The quality and quantity of deflection that is designed into the spars 30 is chosen to optimize the rolling and pitching stability of the main hull 14. When the main hull 14 rolls, it acts to sink or depress one float 42 deeper into the water while simultaneously acting to lift the other float 42 out of the water. If the spars 30 are too stiff, the rolling hull 14 will achieve the undesirable result of just that, i.e., sinking one float 42 while lifting the other. This would be undesirable because the main hull 14 would experience great drag from the sunken float 42 while feeling effectively no drag from the elevated float 42. Then the main hull 14 would be pulled or turned in the direction of the sunken float 42.

When the spars 30 are designed to deflect or yield properly when the main hull 14 rolls, one float 42 would merely be depressed slightly deeper into the water while the other float 42 would ride relatively shallower, but there would not be as great as a difference between the two drag forces that the floats 42 impart to the main hull 14. That way there would not be as much of an imbalanced force that would pull the steering of the main hull 14 in one direction or the other.

Another inventive aspect here concerns the shape and arrangement of the bow 16 of the main hull 14. It includes a pair of inboard recesses 46 configured to store the floats 42 when swung forward to the fully retracted "storage" position (not shown). That is, the spars 30 can be swung forwardly until the floats 42 come to nest in their respective recesses 46. The recesses 46 are configured to fit closely against the floats 42 on at least four sides, which four sides would be—if the floats 42 are likened to a six-sided cube for descriptive purposes only—namely, the upper and lower sides, and the forward and inboard sides. The recesses 46 are open on the outboard and rearward sides of the floats 42. The enlarged bow 16 is given such a shape as shown to shroud the floats 42 when they are stored (not shown). The recesses 46 are preferably open in the rearward area to avoid catching and plowing water when the floats 42 are deployed in "use" positions (i.e., exemplary "use" positions are shown by FIGS. 1 through 3).

The boat hull 14 includes opposite arcuate slots 48 above the recesses 46 to allow the removable passage of the down-links 40 when the floats 42 are either swung in or out of the recesses 46. Portions 50 of the top surface of the boat hull 14—which portions 50 are aft of the arcuate slots 48—are beveled to function as cam surfaces upon which the spars 30 ride when the floats 42 are swung in and out of the recesses 46. The bevel or cam surfaces 50 particularly coact with the spars 30 to ease the alignment of the down-links 40 with the slots 48 and/or ease the alignment of the floats 42 in the recesses 46 when a user is attempting to store and nest the floats 42 in the recesses 46.

Figure 4:
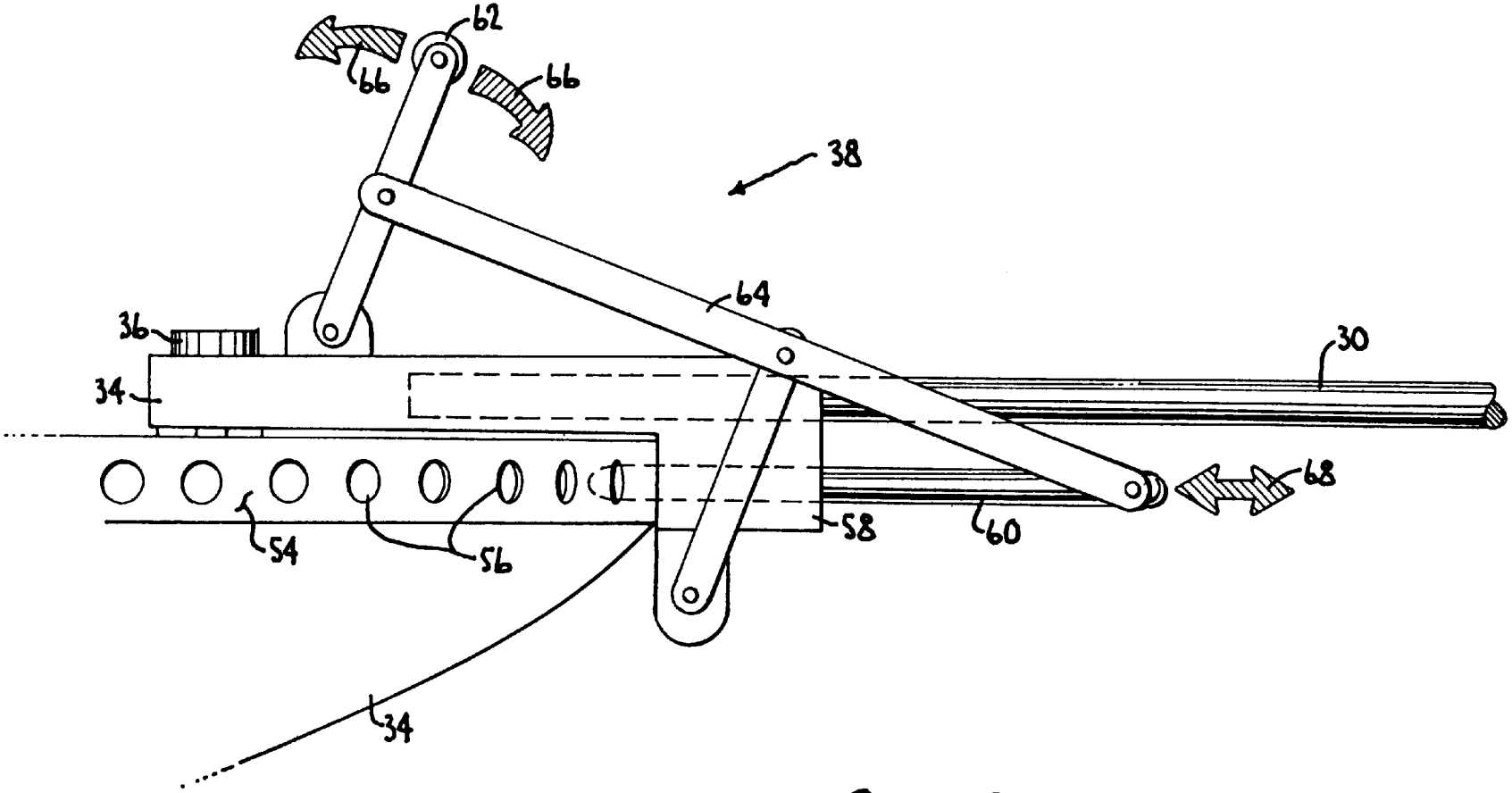
FIG. 4 is an enlarged scale elevational view taken in the direction of arrows IV—IV in FIG. 3.
Figure 5:
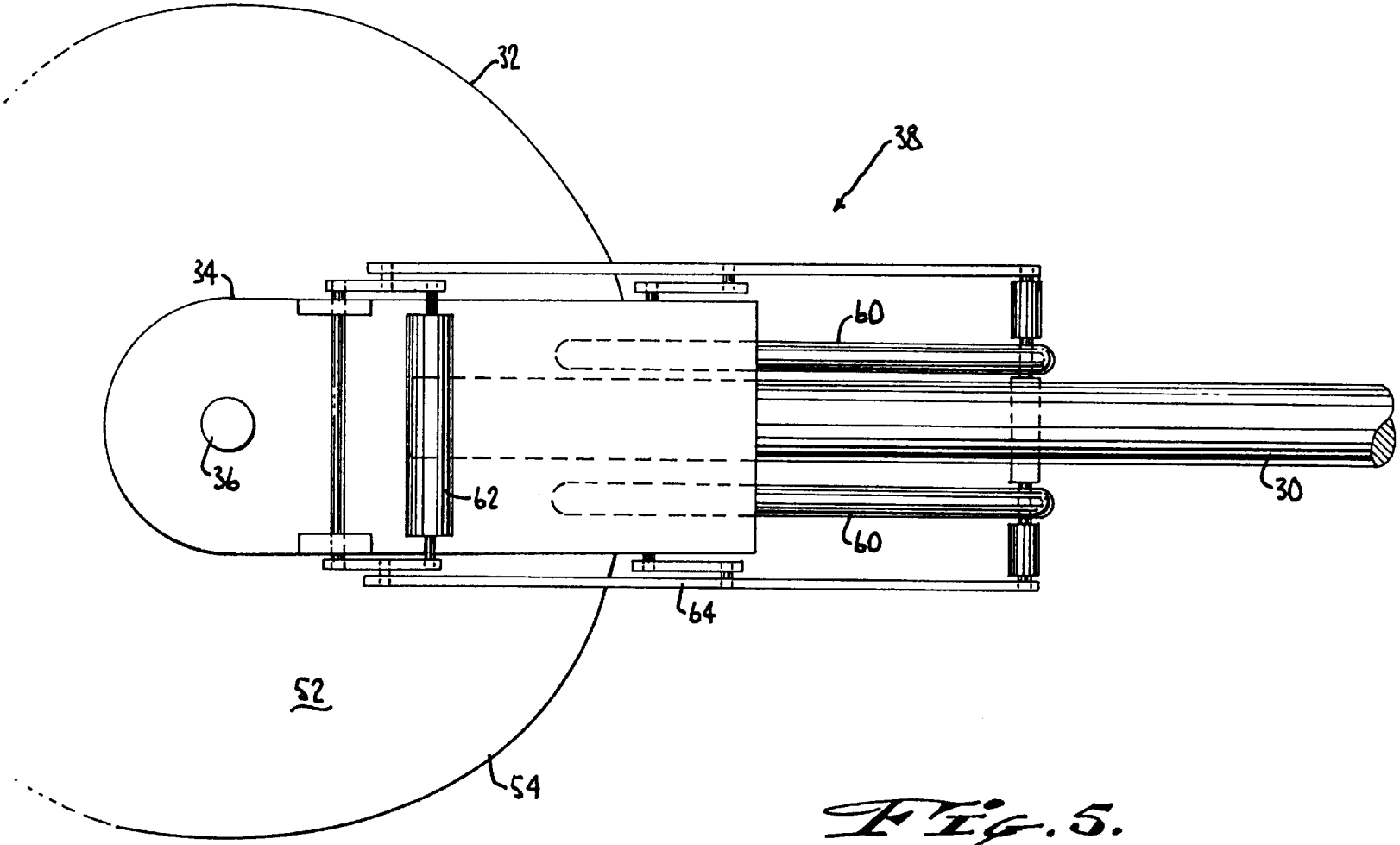
FIG. 5 is a top plan view of FIG. 4.

A further inventive aspect here relates to the cooperation between the swivel-brackets 34 and the turrets 32, as is better shown by FIGS. 4 and 5. The opposite turret structures 32 (left side only shown in FIGS. 4 and 5) define at least a semi-circular flat top 52 delimited by a cylindrical hoop of an edge 54 in which are formed a series of holes 56 (see FIG. 4) spaced every 10° apart between centers. The swivel-bracket 34 is attached to the turret structure 32 by the swivel pin 36 that protrudes up from the axial center of geometry of the turret structure 32. The swivel-bracket 34 extends to terminate in a skirt portion 58 (see FIG. 4) which closely conforms to the hoop edge 54 of the turret structure 32. The swivel-bracket 34 carries the locking mechanism 38 which includes a pair of spaced locking pins 60 for reversibly inserting in any given pair of two holes 56, but which pair of holes 56 are spaced apart by an unused hole 56 immediately therebetween (the arrangement of the two pins 60 being so spaced as to align with two holes 56 spaced by another hole 56 is not shown).

As FIG. 4 shows, the locking pins 60 are actuated by a hand-crank 62. There is a system of actuating links between the hand-crank 62 and the locking pins 60, which links, together with the hand-crank 62, form a four-bar linkage 64. This particular configuration of a four-bar linkage is known in standard reference books as a "D-drive linkage." See, e.g., D. C. Greenwood, ed., "ENGINEERING DATA FOR PRODUCT DESIGN," McGraw-Hill Book Co., 1961, p. 323. An aspect of this linkage configuration 64 is that a given circular input motion (e.g., as indicated by arrows 66 in FIG. 4) is converted into a linear output motion (which is indicated by arrow 68 in FIG. 4). Given the foregoing description of the turret structure 32 and swivel-bracket 34, the spars 30 can be locked in various positions in 10° increments between extreme positions of straight forward and straight rearward (or further), which extreme positions are at least 180° apart.

A still further inventive aspect here is that the spars 30 are independently adjustable. That way, if the prevailing direction of the waves on the sea is from a side of the boat 10, the leeward float 42 can be positioned relatively more straight out from the side of the main hull 14 while the windward float 42 can be positioned relatively more rearwardly. Other arrangements are possible too and would be indeed more preferable for other situations.

Advantages of the invention include the following. The inventive outriggers 12 are adjustable to positions where they not only dampen the rolling of the main hull 14, but also act to dampen the fore-to-aft pitching. To do this, the outriggers 12 can be placed in positions to increase side-to-side stability as well as front-to-back stability. Therefore, the outriggers 12 effectively give the main hull 14 the stability of a craft that has a comparably greater width and length. Also, the two outriggers 12 are much more adjustable than previous configurations, and are independently adjustable as well. Furthermore, the floats 42 can be set in positions where the spray that they plow up does not fall into the passenger compartment 22. This advantage is particularly acute for relatively fast, motor-powered boats, but would be advantageous also for sail-craft too. Additionally, the outrigger spars 30 are given such flexibility so as to reduce the pull on the main hull 14 that results when one float 42 is sunk much deeper in the water than the other. And—whereas this list of advantages is not exhaustive—another advantage given by the invention is the location of the down-link 40 connection 44 on the float 42. It is located forward of the center of geometry of the float 42. That arrangement promotes better parallel alignment of the long axis of the float 42 with the direction of travel of the main hull 14.

Figure 6:
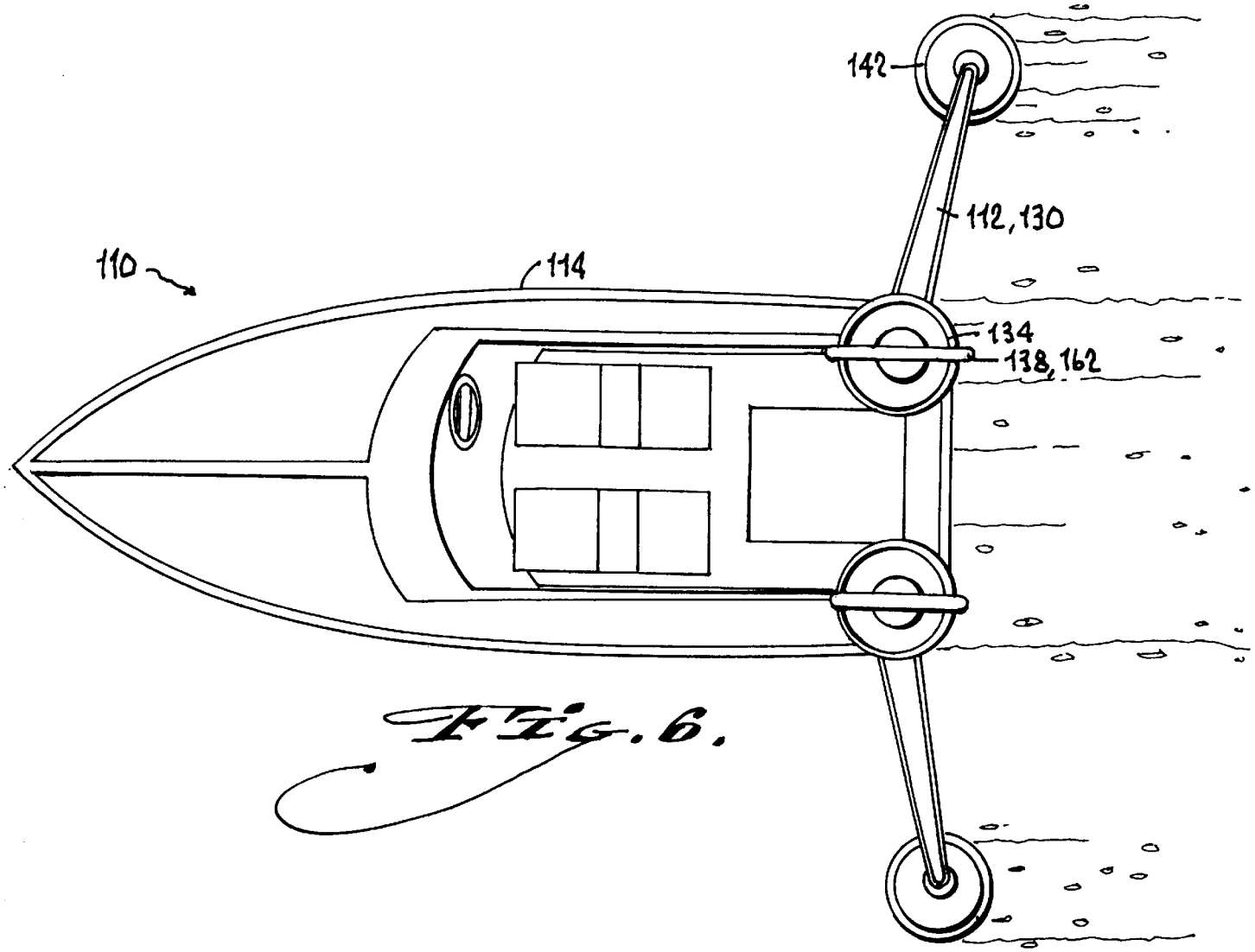
FIG. 6 is a plan view of an alternate embodiment of a boat with adjustable outriggers in accordance with the invention.

FIG. 6 shows an alternate embodiment of a boat 110 having outriggers 112 in accordance with the invention. The outriggers 112 include spars 130 that have turntable bases 134, and from the turntable bases 134 the spars 130 extend to pod-shaped capsizing-resistance members 142. The turntable bases 134 allow adjustment of the position of the capsizing-resistance members 142 through various positions clockwise and counterclockwise including straight outboard and straight rearward, and so on.

Figure 7:
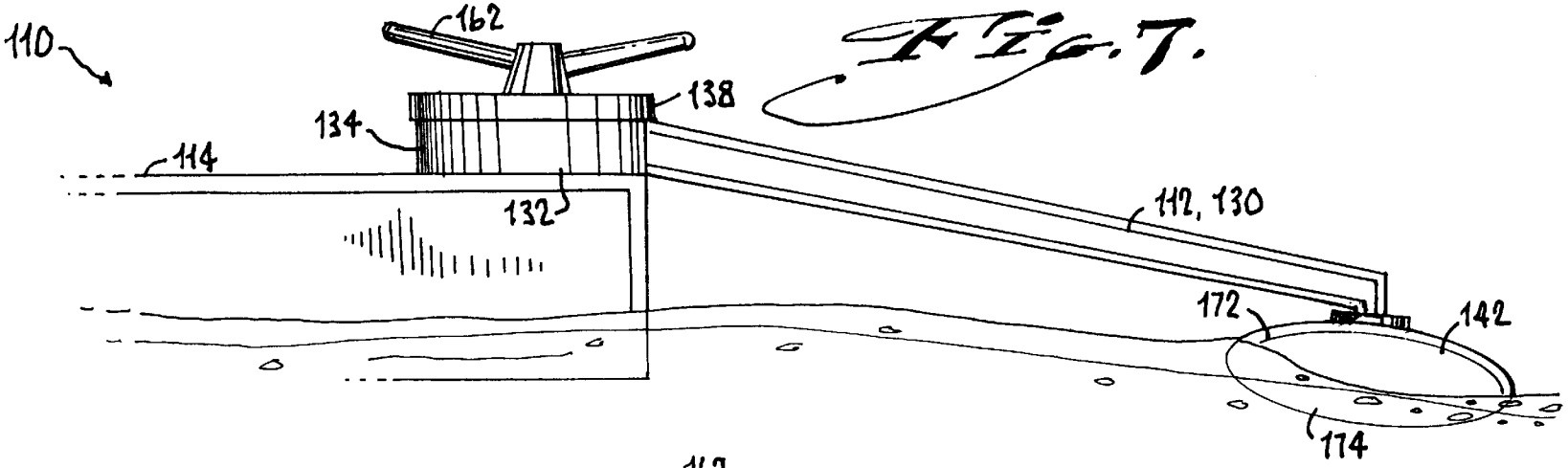
FIG. 7 is an enlarged scale side elevational view thereof, with forward portions broken away.
Figure 8:
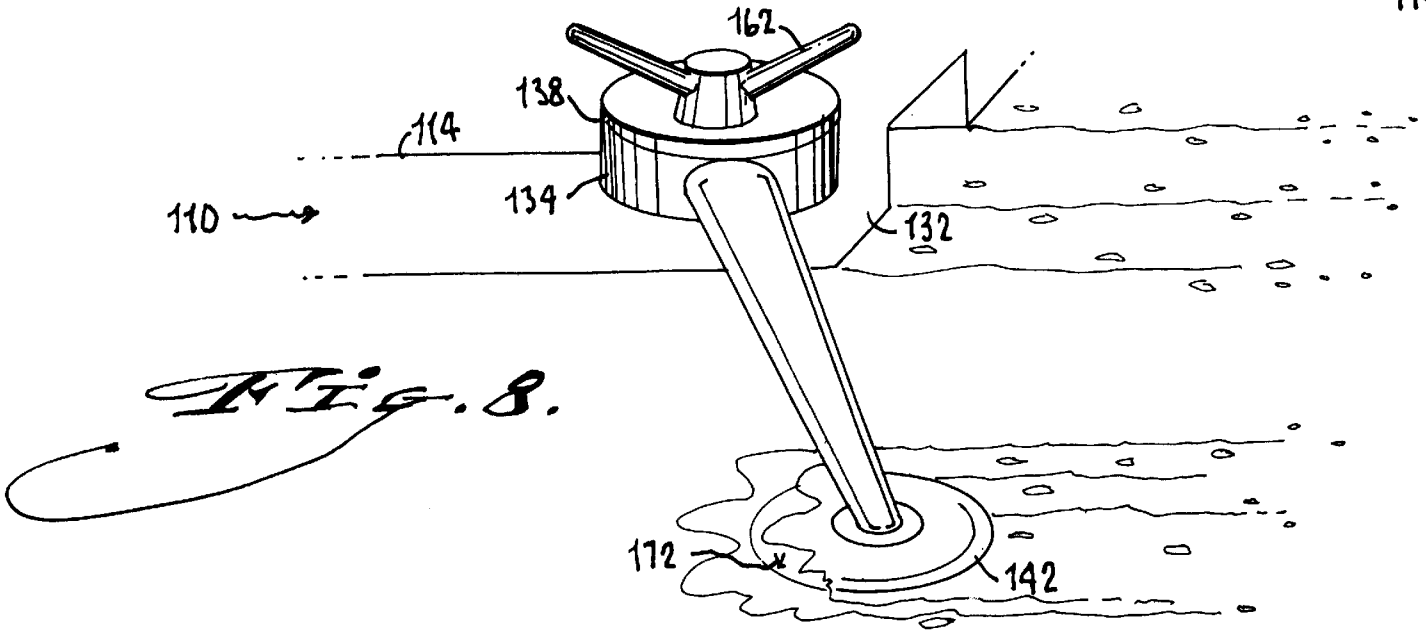
FIG. 8 is a perspective view of FIG. 7.

FIGS. 7 and 8 show that the turntable bases 124 are clamped between a rear corner 132 of the main hull 114 and a locking mechanism 138. The FIGS. 6 through 8 locking mechanism 138 includes a twistable bolt 162 having a cleat-shaped head which not only provides a handhold for tightening and loosening the clamping arrangement 138 but also can double as a cleat for docking or mooring purposes and the like. The advantages of the twistable bolt (or nut) 162 arrangement include that it is relatively simple in construction and economical, and that it allows infinite angular adjustment between the clockwise and counterclockwise extremes of the clamping arrangement 138.

FIGS. 7 and 8 also show further details of the capsizing-resistance pods 142. The pods 142 are pivotably carried at the ends of the outriggers 112 and thus can spin in use. The pods 142 are diminutive relative to the size of the main hull 114, and accordingly displace a substantially small fractional amount of water relative to what the main hull displaces.

In the drawings, the pods 142 are shown skimming the surface of the water, but they are shown that way merely for convenience in this description. It is not necessary for the efficacy of the pods 142 that they skim only. As shown by FIG. 7, each pod 142 has an elevational profile such that it is given an asymmetric foil shape. In accordance with standard airfoil nomenclature, the pod 142 has upper and lower surfaces 172 and 174, and the imaginary surface which lies halfway between the upper and lower surfaces is the "camber" surface (not indicated). For the pods 142, the camber surface is inverted-bowl shaped. Accordingly, the lower surface 174 is the lift surface and the upper surface is the low-pressure or suction surface.

As shown in FIGS. 6 through 8, the pods 142 are skimming on the water surface. As they skim, the pods 142 plane and provide a generally upward, capsizing-resistance force to the outriggers 112 through a center of action, which corresponds approximately to the center of geometry of the pod 142. If the pods 142 are submerged, they are still effective for providing a generally upward, capsizing-resistance force by virtue of "flying" through the water, or else by means of what is termed in this description as "hydrodynamic lift." Planing or hydrodynamic lift aside, the pods 142 provide the generally upward, capsizing-resistance force about through their center of geometry generally whenever they are in contact with the water and under forward velocity. The foregoing is an inventive aspect of what is presently disclosed because prior-art outrigger pontoons develop a capsizing-resistance force substantially through buoyance forces alone. In accordance with the invention, the floats 42 depicted in FIGS. 1 through 3 develop a capsizing-resistance force through a combination of buoyancy forces and planing forces. The capsizing-resistance pods 142 either plane on or fly through the water. Accordingly, they develop a capsizing-resistance force by means of planing or hydrodynamic lift, respectively. In view of the foregoing, a relatively diminutive capsizing-resistance formation 42 or 142 can develop a moderate capsizing-resistance force despite being so small. The moderate capsizing-resistance force can be amplified into a meaningful capsizing-resistance moment if the outrigger is sufficiently long.

Figure 9:
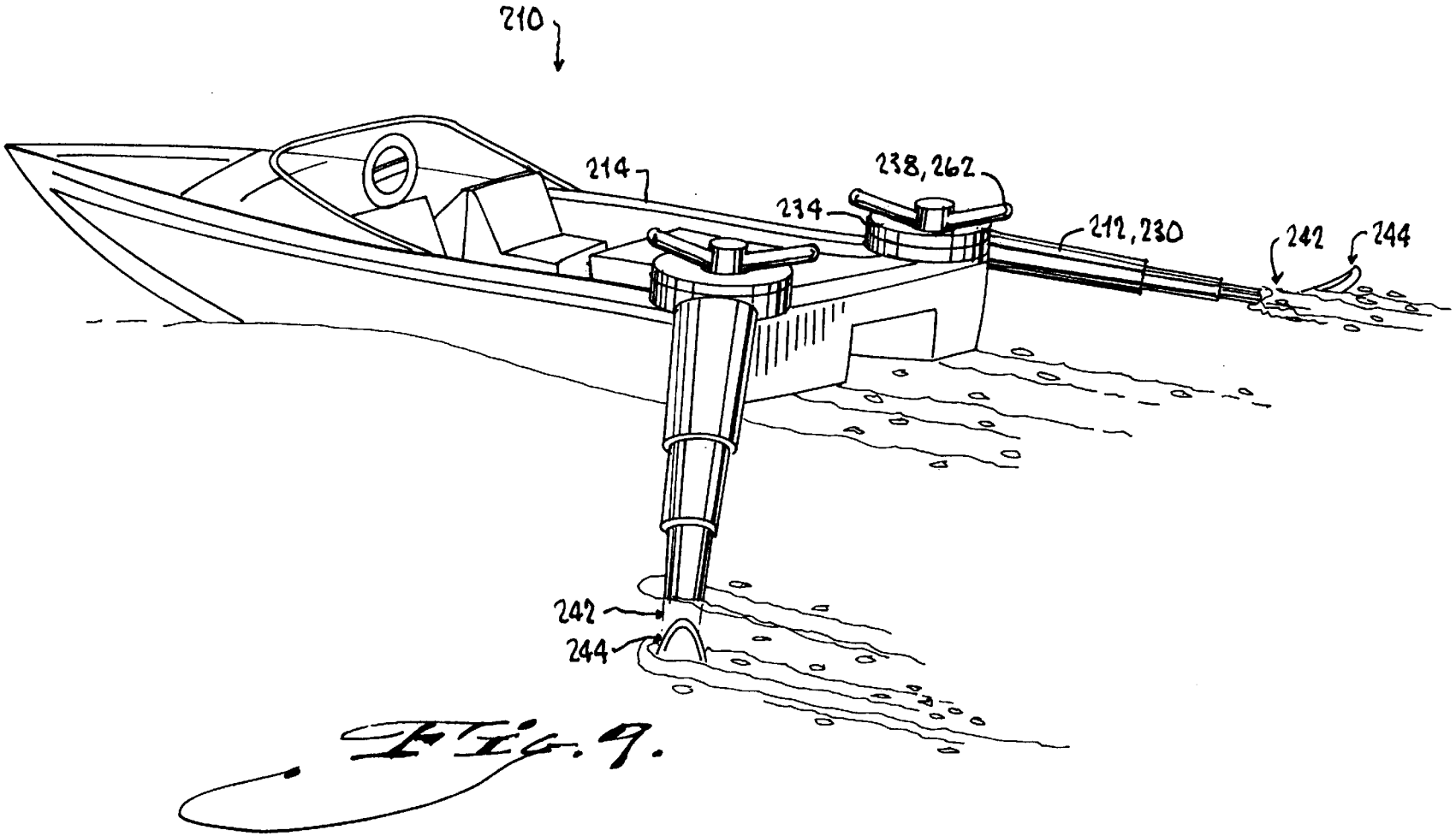
FIG. 9 is a perspective view of an additional embodiment of a boat with adjustable outriggers in accordance with the invention.

FIG. 9 shows an additional embodiment of a boat 210 having outriggers 212 in accordance with the invention. The outriggers have comparable turntable bases 234 as shown by the FIGS. 6 through 8 embodiment, as well as comparable clamping arrangements 238 having bolts 262 formed with a cleat-shaped heads.

The outrigger spars 230 comprise telescopic sleeves that allow extension and retraction between extreme extended positions (e.g., as shown) and extreme foreshortened positions (not shown) for adjustability as desired. The outrigger spars 230 extend from their bases 234 to distal curved or upturned end portions 242. The distal end portions 242 are submerged in their middles but they reemerge such that, as shown, their terminal ends 244 elevated slightly above the water surface.

The distal end portions 242 are given an asymmetric foil shape such that their lower surface regions are the lift surfaces and the upper surface regions are their low-pressure or suction surfaces. Accordingly, the distal end portions 242 provide hydrodynamic lift under velocity. Their upturned ends 244 minimize slip losses and increase the efficacy of the foil portions 242. It can be reckoned that the submerged portions 242 and/or 244 of the outriggers 212 displace a substantially small fractional amount of water relative to what the main hull 214 displaces. The capsizing-resistance foils 242 provide hydrodynamic lift through a center of action which approximately corresponds to the center of geometry of the submerged portion. The full amount of hydrodynamic lift developed may perhaps be merely modest even at substantial speeds. However, given the telescopic spars 230, even a modest capsizing-resistance force can be amplified into a meaningful capsizing-resistance moment by virtue of increased extension of the outriggers 212.

The swivelling adjustability of the outriggers 212 allows positioning of the capsizing-resistance portions 242 among various positions of generally outboard and rearward such that the centers of hydrodynamic lift lie spaced substantially straight outboard if desired, or substantially rearward, spaced substantially behind a plane containing the stern of the main hull 214, and so on.

The foregoing arrangements allow a user to choose a given position for the capsizing-resistance portions 242 among the available choices in order to stabilize fore-to-aft pitching as well as side-to-side rolling of the main hull 214. It is an inventive aspect of the capsizing-resistance foil portions 242 that they provide a relatively substantial capsizing-resistance moment when they are actually a relatively diminutive hydrofoil. Partly this is accomplished by virtue of, at increasing speeds, they provide an increasing capsizing-resistance force (i.e., increasing hydrodynamic lift). Also, the capsizing-resistance moment that does result is a factor of the length of the outrigger spars 230. The combined factors of (i) capsizing-resistance force and (ii) the distance between the center of the capsizing-resistance force and main hull 214's centerline, give what the main hull feels in terms of capsizing resistance:—namely, a capsizing-resistance moment.

Figure 10:
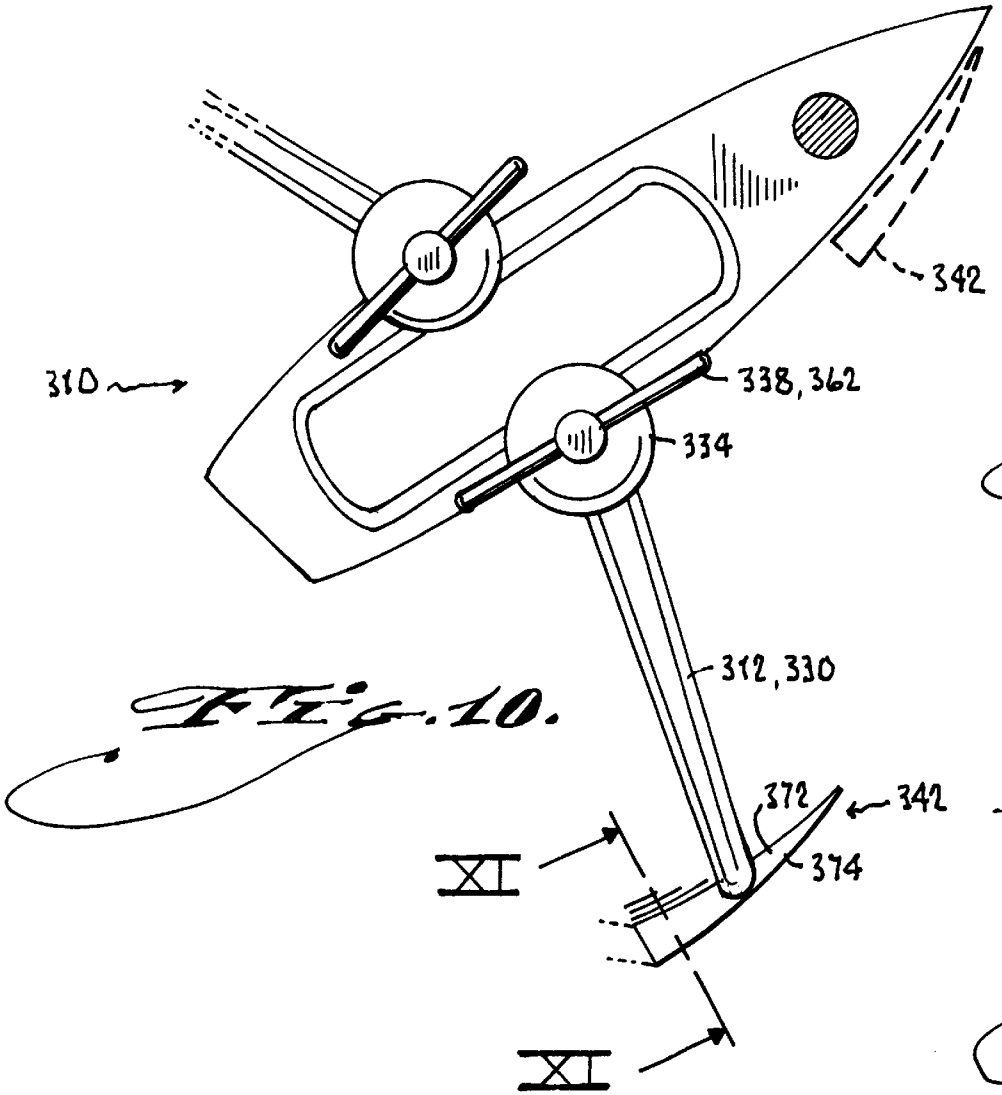
FIG. 10 is a plan view of another embodiment of a boat with adjustable outriggers in accordance with the invention.

FIG. 10 shows another embodiment of a boat 310 having adjustable outriggers 312 in accordance with the invention. The boat hull 314 is representative of sailboats or sail craft generally, rather than the motor boat hulls shown by the previous drawing views. The outriggers 312 include turntable bases 334 that are mounted amidships to the main 314 rather than on the rear corners. The turntable bases 334 are clamped by a comparable clamping arrangement 338 and cleat-shaped bolt 362 as shown by FIGS. 6 through 9.

The outriggers 312 carry capsizing-resistance floats 342. These floats have been shaped and arranged such that when placed straight outboard of the main hull 314, the spray that trails them is thrown the opposite direction from the main hull 314. The spray falling the opposite way insures that the passengers riding in the main hull won't be soaked by use of the outriggers 312 and floats 342. FIG. 10 also shows in dashed lines the location for the floats 342 in a storage or non-use position. The floats 342 are conformal to the hull shape to rest substantially against the forepart of the hull as shown. This allows convenient trailering of the boat 310 and/or maneuverability through tight harbors or passages and the like.

Figure 11:
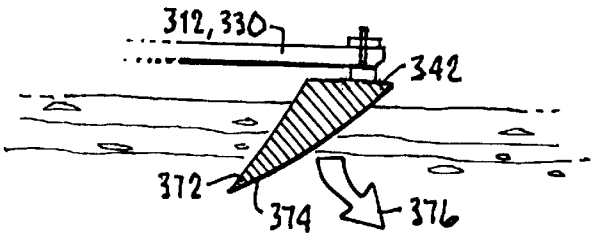
FIG. 11 is an enlarged scale sectional view taken in the direction of arrows XI—XI in FIG. 10; and, FIG. 12 is a comparable elevational view taken in the direction of arrows XI—XI in FIGURE

FIG. 11 shows that the floats 342 are shaped and arranged to throw spray in the outboard direction (i.e., to the right in FIG. 11). The float 342 has proximal and distal side surfaces 372 and 374. The distal side surface 374 is inclined outboard in the upward direction (as shown) in order to develop a planing force normal (i.e., at right angles) to itself (i.e., the distal side surface 374), as indicated by direction arrow 376. As a result much spray will be thrown by the distal side surface 374.

Concurrently, the proximal side surface 372 ought to be shaped so as not to throw spray. It can be inclined as shown, outboard in the upward direction, or it can be arranged to extend nearly vertical (not shown). Given the shape of the two sides 372 and 374, the float 342 as a whole behaves something like a banking slalom water ski:—namely, spray is thrown in the direction the ski is banked but not in the direction of the inside of the turn.

Figure 12:
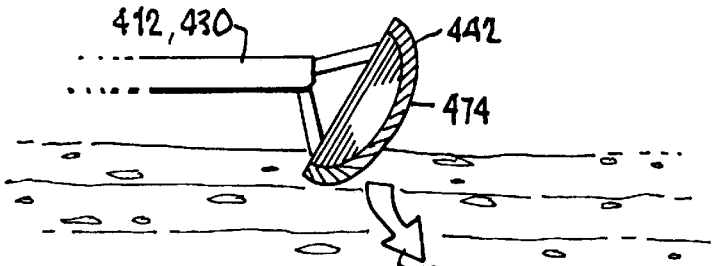

The objects of the invention achieved by the configuration of floats 342 as shown by FIGS. 10 and 11, can be achieved by floats (or capsizing-resistance formations) given about any other suitable shape for the purpose, including the configuration for capsizing-resistance formation 442 shown in FIG. 12.

The capsizing-resistance formation 442 is attached to the end of the spar 430 of the outrigger 412 as can be reckoned with reference to the previous drawing views. The capsizing-resistance formation 442 has the shape a spherical cap, although it might more-commonly be reckoned as a disk. The capsizing-resistance disk 442 has a planing surface 474 which develops a normal planing force in the direction or reference arrow 476. As comparable to FIG. 11, the disk 442 throws much spray in the direction of planing surface 474 as it moves forwardly through the water (the "forward" direction being straight into the depth of the view), but no spray or nearly none in the opposite direction. Unlike the FIGS. 10 and 11 float, the capsizing-resistance formation or disk 442 is not especially buoyant. All its capsizing-resistance force is developed by planing, not buoyancy. A person having ordinary skill would recognize that the same useful work provided by the disks 442 shown in FIG. 12, can be gotten from any of an indefinite number of other shapes and configurations.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A boat having:

a main hull having a bow and a stern and opposite side beams, outriggers mounted to the main hull, and extending from the main hull to distal portions formed as capsizing-resistance formations, wherein each capsizing-resistance formation is sized such that it displaces a substantially small fractional amount of water relative to what the main hull displaces, and is shaped and arranged such that in contact with the water under forward velocity it provides a generally upward capsizing-resistance force through a given center of action which is transmitted by the outrigger to the main hull as an applied capsizing-resistance moment, wherein the outriggers position of the capsizing-resistance formations generally outboard and rearward such that said centers of the upward capsizing-resistance force lie spaced substantially behind a plane containing the stern of the main hull in order to stabilize the fore-to-aft pitching as well as side-to-side rolling of the main boat hull in accordance with boat speed and wave conditions.

2. The boat of claim 1, wherein the outriggers comprise spars, and the capsizing-resistance formations comprise portions of the spars given one of a planing-surface shape substantially for skimming the water surface, and, an asymmetric foil shape.

3. The boat of claim 1, wherein the capsizing-resistance formations comprise one of floats shaped and arranged to skim the water surface and provide an upward capsizing-resistance force which comprises a combination of buoyancy and planing forces, planes shaped and arranged to plane on the water surface and provide an upward capsizing-resistance force which comprises substantially planing forces, and asymmetric foils shaped and arranged to plane the water surface or fly if submerged and provide an upward capsizing-resistance force which is alternatively substantially a planing force or hydrodynamic lift.

4. The boat of claim 1, wherein the outriggers comprise one of fixed and adjustable arrangements, the adjustable arrangement comprising adjustable mechanisms that allow adjustment of the position of the capsizing-resistance formations among various positions of generally outboard and rearward such that said centers of upward capsizing-resistance force lie spaced substantially behind a plane containing the stern of the main hull.

5. The boat of claim 4, wherein the adjustable mechanisms comprise turntable bases for the outriggers that allow swivelling between extreme clockwise and counterclockwise positions.

6. The boat of claim 5, wherein the turntable bases include clamping arrangements to lock the turntable base in given positions.

7. The boat of claim 4, wherein the adjustable mechanisms comprise telescoping sections that are extendible and retractable between extended and foreshortened extremes.

8. The boat of claim 1, wherein the outriggers are mounted to the main hull proximate the opposite rear corners thereof.

9. The boat of claim 1, wherein the outriggers are mounted to the main hull amidships thereof.

10. A boat having:

a main hull having a bow and a stern and opposite side beams, outriggers mounted to the main hull, and extending from the main hull to distal portions formed as capsizing-resistance formations, wherein each capsizing-resistance formation is sized such that it displaces a substantially small fractional amount of water relative to what the main hull displaces, and is shaped and arranged such that in contact with the water under forward velocity it provides a generally upward capsizing-resistance force through a given center of action which is transmitted by the outrigger to the main hull as an applied capsizing-resistance moment, wherein the outriggers position of the capsizing-resistance formations substantially outboard such that said centers of the upward capsizing-resistance force lie spaced substantially outboard of the side beams of the main hull in order to stabilize the side-to-side rolling of the main boat hull in accordance with boat speed and wave conditions, whereby a relatively diminutive capsizing-resistance formation relative to the size of the main hull, can give at velocity a substantial capsizing-resistance moment, and, wherein the outriggers comprise spars, and the capsizing-resistance formations comprise portions of the spars given one of a planing-surface shape substantially for skimming the water surface, and, an asymmetric foil shape.

11. A boat having:

a main hull having a bow and a stern and opposite side beams, outriggers mounted to the main hull, and extending from the main hull to distal portions formed as capsizing-resistance formations, wherein each capsizing-resistance formation is sized such that it displaces a substantially small fractional amount of water relative to what the main hull displaces, and is shaped and arranged such that in contact with the water under forward velocity it provides a generally upward capsizing-resistance force through a given center of action which is transmitted by the outrigger to the main hull as an applied capsizing-resistance moment, wherein the outriggers position of the capsizing-resistance formations substantially outboard such that said centers of the upward capsizing-resistance force lie spaced substantially outboard of the side beams of the main hull in order to stabilize the side-to-side rolling of the main boat hull in accordance with boat speed and wave conditions, whereby a relatively diminutive capsizing-resistance formation relative to the size of the main hull, can give at velocity a substantial capsizing-resistance moment, and, wherein the capsizing-resistance formations comprise one of floats shaped and arranged to skim the water surface and provide an upward capsizing-resistance force which comprises a combination of buoyancy and planing forces, planes shaped and arranged to plane on the water surface and provide an upward capsizing-resistance force which comprises substantially planing forces, and asymmetric foils shaped and arranged to plane the water surface or fly if submerged and provide an upward capsizing-resistance fore which is alternatively substantially a planing force or hydrodynamic lift.

12. The boat of claim 11, wherein the outriggers are mounted to the main hull proximate the opposite rear corners thereof.

13. The boat of claim 11, wherein the outriggers are mounted to the main hull amidships thereof.

14. A boat having:

a main hull having a bow and a stern and opposite side beams, outriggers mounted to the main hull, and extending from the main hull to distal portions formed as capsizing-resistance formations, wherein each capsizing-resistance formation is sized such that it displaces a substantially small fractional amount of water relative to what the main hull displaces, and is shaped and arranged such that in contact with the water under forward velocity it provides a generally upward capsizing-resistance force through a given center of action which is transmitted by the outrigger to the main hull as an applied capsizing-resistance moment, wherein the outriggers of the capsizing-resistance formations substantially outboard such that said centers of the upward capsizing-resistance force lie spaced substantially outboard of the side beams of the main hull in order to stabilize the side-to-side rolling of the main boat hull in accordance with boat speed and wave conditions, whereby a relatively diminutive capsizing-resistance formation relative to the size of the main hull, can give at velocity a substantial capsizing-resistance moment, wherein the outriggers comprise one of fixed and adjustable arrangements, the adjustable arrangement comprising adjustable mechanisms that allow adjustment of the position of the capsizing-resistance formations among various positions of generally outboard and rearward such that said centers of upward capsizing-resistance force lie spaced substantially behind a plane containing the stern of the main hull, and, wherein the adjustable mechanisms comprise turntable bases for the outriggers that allow swivelling between extreme clockwise and counterclockwise positions.

15. The boat of claim 14, wherein the turntable bases include clamping arrangements to lock the turntable base in given positions.

16. The boat of claim 14, wherein the adjustable mechanisms comprise telescoping sections that are extendible and retractable between extended and foreshortened extremes.

17. A boat having:

a main hull having a bow and a stern and opposite side beams, a pair of capsizing-resistance pods, outriggers for supporting the capsizing-resistance pods, wherein each capsizing-resistance pod is sized such that it displaces a substantially small fractional amount of water relative to what the main hull displaces, and is shaped and arranged such that in contact with the water under forward velocity it provides a generally upward capsizing-resistance force through a given center of action which is transmitted by the outrigger to the main hull as an applied capsizing-resistance moment, the outriggers being adjustably mounted to the main boat hull for adjustable placement in various positions of relative spacing apart from the outboard beam of the main boat hull including an extreme outward position in which the capsizing-resistance pods are generally straight outboard and spaced substantially away from the outboard beam of the main boat hull, whereby a user can choose a given position for the capsizing-resistance pods from among the various positions in order to stabilize the side-to-side rolling of the main hull in accordance with boat speed and wave conditions, wherein each capsizing-resistance pod has proximal and distal side surfaces relative to the main boat hull, of which, the distal side surface is inclined outboard in the upward direction, and, the proximal side surface is oriented one of generally vertical or inclined outboard in the upward direction, in order that the spray that the capsizing-resistance pods displace under forward velocity is thrown outboard and away from the main boat hull for the comfort of passengers in the main hull.

18. The boat of claim 17, wherein the outriggers comprise one of fixed and adjustable arrangements, the adjustable arrangement comprising adjustable mechanisms that allow adjustment of the position of the capsizing-resistance pods among various positions of generally outboard such that said centers of upward capsizing-resistance force lie spaced substantially outboard of the side beams of the main hull, whereby a user can choose a given position for the capsizing-resistance pods from among the various positions between the extremes in order to stabilize the side-to-side rolling of the main in accordance with boat speed and wave conditions.

* * * * *